United States Patent [19]

Thomas, Jr.

[11] Patent Number: 5,059,940

[45] Date of Patent: Oct. 22, 1991

[54] SINGLE TURN POTENTIOMETER WITH DIRECT ROTOR-TO-HOUSING SEAL

[75] Inventor: Ronald E. Thomas, Jr., Alta Loma, Calif.

[73] Assignee: Bourns, Inc., Riverside, Calif.

[21] Appl. No.: 469,639

[22] Filed: Jan. 24, 1990

[51] Int. Cl.[5] ..... H01C 10/32

[52] U.S. Cl. ..... 338/164; 338/174

[58] Field of Search ..... 338/164, 184, 199, 174

[56] References Cited

U.S. PATENT DOCUMENTS

| | | | |
|---|---|---|---|
| 3,488,618 | 1/1970 | Yungblut et al. | 338/164 |
| 3,518,604 | 6/1970 | Beaver et al. | 338/164 |
| 3,531,860 | 10/1970 | Paine et al. | 29/610 |
| 4,110,722 | 8/1978 | Brendle et al. | 338/174 |
| 4,626,823 | 12/1986 | Smith | 338/199 |

*Primary Examiner*—Marvin M. Lateef

*Attorney, Agent, or Firm*—Howard J. Klein; William G. Becker

[57] ABSTRACT

In a miniature, single-turn potentiometer, a fluid-tight seal is formed between the rotor and the housing by the interference fit between an annular ridge on the peripheral edge of the rotor and a conforming groove in the interior wall surface of the housing cavity in which the rotor is installed. In a preferred embodiment of the invention, there are two parallel ridges and grooves, and they are configured to form a "chevron" seal, in which the ridges have a substantially saw-tooth shape in axial cross-section, with the grooves having a complementary shape. The chevron seal provides a direct, rotor-to-housing seal that is fluid-tight, without the use of an O-ring, while also restraining the rotor from axial movement with respect to the housing.

21 Claims, 2 Drawing Sheets

SINGLE TURN POTENTIOMETER WITH DIRECT ROTOR-TO-HOUSING SEAL

BACKGROUND OF THE INVENTION

This invention relates broadly to the field of single turn potentiometers, of the type commonly referred to as "trimmer" potentiometers. More specifically, this invention relates to the construction of a fluid-tight seal between the rotor of such a potentiometer and the housing in which the rotor is installed.

Single turn "trimmer" potentiometers are well-known in the electronic field, and have long been useful in a wide variety of applications. The typical trimming potentiometer includes an insulating housing (usually plastic) encapsulating an insulating substrate (usually a ceramic), on which is formed a resistive element and several metallized conductive elements to which the leads are attached. A rotor is installed in the housing for rotation therein, the rotor having an interior surface on which is mounted a wiper contact for establishing electrical contact between the resistive element and one of the metallized conductive elements.

In many applications, it is necessary or desirable to seal the interior of the potentiometer from the entry of particulate or liquid contaminants, particularly cleaning solutions. Typically, this is done with an O-ring placed between the rotor and the housing. See, for example, U.S. Pat. No. 4,626,823 to Smith. There are a number of drawbacks, however, to the use of O-rings. For example, O-rings tend to deteriorate with age, thereby resulting in a degraded seal. Also, the resiliency of O-rings gives them a tendency to "wind up" when the rotor is turned, and then to spring back, thereby shifting the setting of the rotor. Moreover, the resiliency of the O-ring tends to decrease with time, thereby altering the rotational torque characteristics of the rotor. Finally, with respect to miniature potentiometers (i.e., those with horizontal dimensions of approximately 5 mm or less), it is very difficult to obtain precision O-rings sufficiently small in size to fit such components.

Consequently, the prior art has sought alternatives to O-rings to perform the necessary sealing function. For example, U.S. Pat. No. 3,518,604 to Beaver et al. shows a potentiometer with a rotor that is flared outwardly at its periphery to seal against the edge of the aperture in which the rotor is seated. U.S. Pat. No. 3,531,860 to Paine et al. shows a potentiometer in which the rotor has a peripheral flange with an upturned lip that seals against an internal shoulder in the housing. While these prior art approaches may yield satisfactory results in some applications, there has been a continuing need for improving the integrity and durability of the rotor-to-housing seal, especially in potentiometers of so-called "hot rotor" type, in which the rotor is made of a metal. In this type of potentiometer, a fluid-tight seal must be formed between the metal rotor and the plastic housing, and prior art techniques have heretofore yielded less than satisfactory results.

SUMMARY OF THE INVENTION

Broadly, the present invention is an improved potentiometer, of the type having a substrate with a resistive element and a plurality of metallized conductive elements thereon, a rotor carrying a conductive wiper, and a housing that contains the substrate and the rotor, with a portion of the housing forming a cavity that receives the rotor, wherein the improvement comprises a fluid-tight seal formed between the peripheral edge of the rotor and the interior wall surface of the cavity.

More specifically, the fluid-tight seal is formed between an annular ridge on the peripheral edge of the rotor, and a complementary groove in the interior wall surface of the cavity, with the ridge and the groove being dimensioned to provide a fluid-tight interference fit between them that both allows the rotation of the rotor within the cavity, while restraining the rotor from substantial axial movement with respect to the substrate.

In a preferred embodiment of the invention, the seal is of the type frequently referred to as a "chevron" seal. In a chevron seal, the annular ridge on the rotor edge has a substantially saw tooth configuration in axial cross-section, with the cavity groove having a complementary shape. In the specific preferred embodiment disclosed herein, the rotor has a first surface directed toward the interior of the housing, and a second surface directed toward the exterior of the housing. The saw tooth outline of the ridge has a long side that tapers radially inwardly in the axial direction toward the first rotor surface, and a short side that is essentially perpendicular to the axis of the rotor, the long and short sides meeting at an acute angle.

The direct rotor-to-housing seal provided by the present invention offers a number of significant advantages, especially when used in miniature single turn "trimmer" potentiometers. Of primary importance is the provision of an excellent fluid-tight seal between the rotor and the housing, without the use of an O-ring. This direct, surface-to-surface seal also provides good rotational torque characteristics for the rotor, without the "wind-up", "spring-back", or torque changes over time associated with O-rings. Finally, axial movement of the rotor with respect to the substrate, due to the pressure of the wiper against the substrate and the thermal expansion of the air between the rotor and the substrate, is substantially eliminated. The present invention enables all of these advantages to be achieved in so-called "hot rotor" potentiometers, in which the rotor is made of a metal that interfaces with an injection-molded plastic housing.

These and other advantages will be more readily appreciated from the detailed description of the invention that follows.

DETAILED DESCRIPTION OF THE PREFERRED EMBODIMENT

Figure 1:
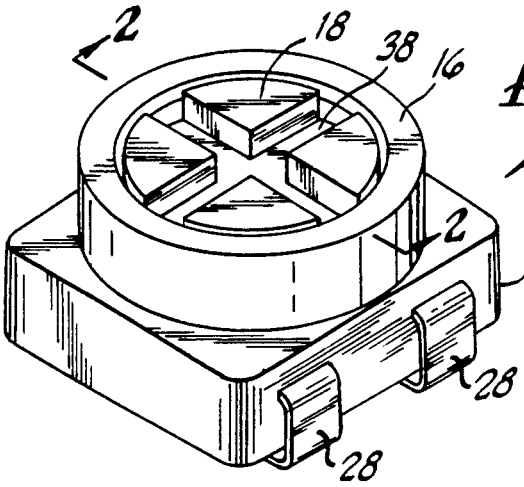
FIG. 1 is a perspective view of a miniature, single turn trimmer potentiometer incorporating a rotor-to-housing seal in accordance with the present invention.

Referring now to the drawings, there is illustrated a miniature, single turn trimmer potentiometer 10, which is of conventional construction except for the novel sealing mechanism of the present invention. The potentiometer 10 comprises a housing 12 that encapsulates a ceramic substrate 14. The housing 12 has a hollow, cylindrical extension 16, open at the top, that is dimensioned to receive and contain a rotor 18. In the illustrated embodiment, the potentiometer is a so-called "hot rotor" potentiometer, meaning that the rotor 18 is made of a metal. The preferred material for the rotor 18 is 303 stainless steel, although other metals, such as brass and aluminum, may be acceptable in certain applications. The housing 12 is made of an injection-molded thermoplastic polymer. As will be explained more fully below, the preferred material for the housing is a high flow (150 GL 30), glass-filled polyetheretherketone (PEEK), although other materials may be acceptable.

Figure 4:
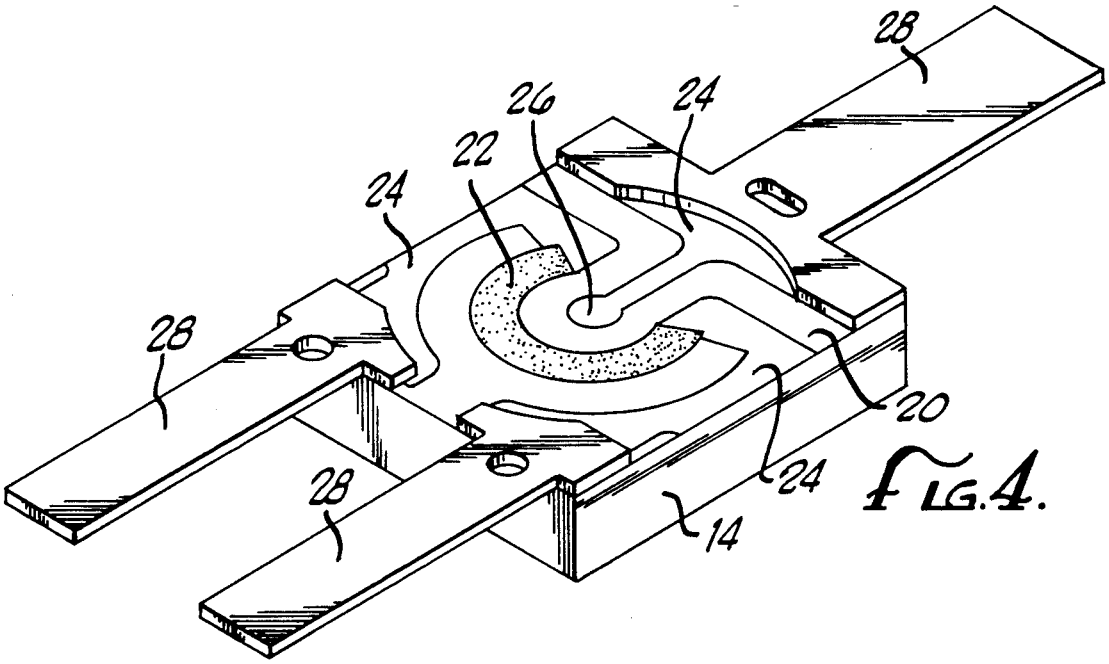
FIG. 4 is a perspective view of the substrate and lead assembly of the potentiometer of FIG. 1, prior to encapsulation in the housing.

As best shown in FIG. 4, the substrate 14 has an upper surface 20 on which is formed an arcuate resistive element 22, typically formed of a cermet ink. Also formed on the substrate surface 20 are a plurality of metallized conductive areas 24 that provide conductive pads or terminals for the potentiometer. One of the conductive areas extends into the center of curvature for the resistive element 22, forming a collector 26. Brazed or welded to each of the conductive areas 24 is a conductive lead 18. If the substrate is to be installed in a surface-mounted device, the ends of the leads 28 are bent to engage the underside of the housing, as best shown in FIG. 2, after the substrate is encapsulated.

Figure 2:
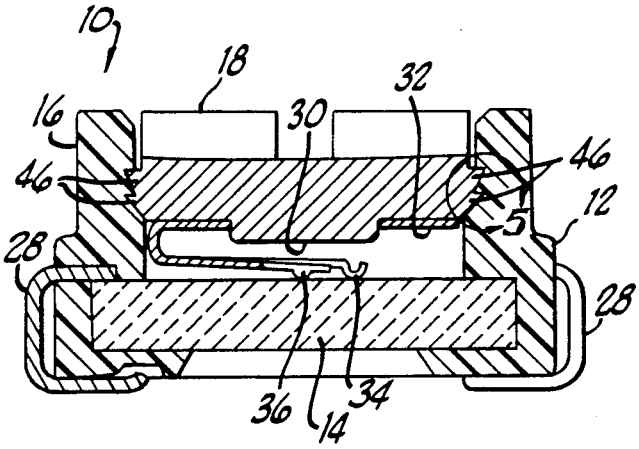
FIG. 2 is a cross-sectional view taken along line 2—2 of FIG. 1.

The rotor has an interior surface that is formed with a central projection or hub 30 (FIG. 2). Attached to the interior rotor surface around the hub 30 is a metal wiper element 32 having a first resilient contact finger 34, and a second resilient contact finger 36. The first finger 34 is positioned to maintain a positive-pressure contact with the resistive element 22, while the second finger 36 is positioned to maintain a positive-pressure contact with the collector 26. The rotor 18 has an exterior surface that has a cruciform slot 38 to accommodate a driving tool (not shown), as is well-known in the art.

Figure 3:
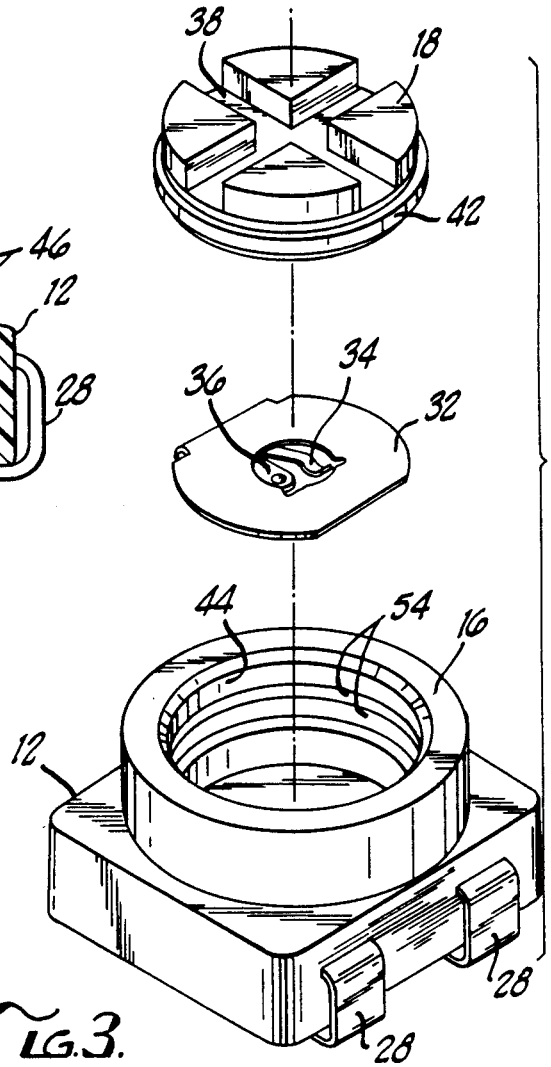
FIG. 3 is an exploded perspective view of the potentiometer of FIG. 1, showing the rotor, the wiper, and the housing.
Figure 5:
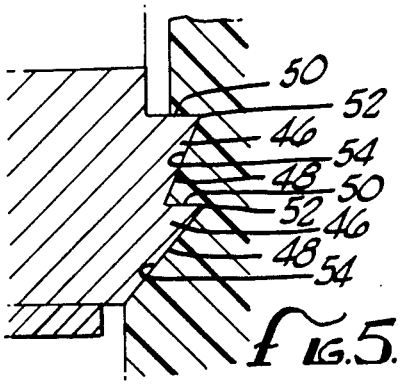
FIG. 5 is a detailed cross-sectional view of a portion of the sealing mechanism enclosed within the dashed circle 5 in FIG. 2.

The novel sealing mechanism of the present invention is illustrated in FIGS. 2, 3, and 5. This sealing mechanism, which provides a direct, surface-to-surface seal between the rotor 18 and the housing 12, is of a type sometimes referred to as a "chevron" seal, because of the configuration of the sealing elements, as will be appreciated from the following description.

The chevron seal comprises a first sealing element formed on the peripheral edge 42 of the rotor 18, and a second sealing element formed in the interior wall surface 44 of the cylindrical extension 16 of the housing 12. In the preferred embodiment shown in the drawings, the first sealing element comprises two parallel annular ridges 46 extending from the peripheral edge 42 of the rotor 18. The ridges 46 are integral with the rest of the rotor 18, and at least one such ridge is needed, although two is the preferred number, and more than two may be used if desired. As shown in FIG. 2, the ridges 46 are of a substantially saw tooth configuration in axial cross-section, yielding a chevron-like cross-sectional shape for the rotor 18.

As best shown in FIG. 5, each of the ridges 46 has a long side 48 and a short side 50, when viewed in cross-section, the two sides meeting at a vertex 52 of an acute angle. The long side 48 is directed radially inwardly as it extends axially from the vertex 52 toward the interior surface of the rotor 18. The short side 50 is essentially perpendicular to the axis of the rotor, so that each of the ridges 46 has an upper surface that is substantially orthogonal to the axis of rotation of the rotor.

The second sealing element comprises a pair of grooves 54 that are formed in the interior wall surface 44 of the cylindrical housing extension 16 by the insertion of the rotor, as explained below. The grooves 54 are complementary with, and conformal to, the ridges 46. To achieve a fluid-tight seal between the ridges 46 and the grooves 54, it is preferable to dimension these elements so that there is an interference fit between them, the intersurface friction between the rotor material and the housing material being sufficiently low to allow the rotation of the rotor with acceptable levels of torque.

The structure described above may be obtained with any of several fabrication methods.

Preferably, the rotor (which is made of metal) is preheated to a temperature which is near the glass transition temperature of the housing material, prior to insertion into the housing. In the case of 150 GL 30 PEEK, this temperature is approximately 290 degrees Centigrade. This technique allows the plastic material of the housing to reflow momentarily during the insertion to produce the grooves 54, with a minimum of stress in the housing, while maintaining the seal integrity of the ridges 46 on the rotor.

Alternatively, the housing may be preheated to approximately 215 degrees Centigrade prior to insertion of the rotor, with no preheating of the rotor. Ultrasonic insertion techniques can also be used, if care is taken not to damage the cermet resistive element.

The 150 GL 30 grade PEEK that is used for the housing material, as discussed above, has characteristics that make it particularly well-suited to this invention. Specifically, it has an ability to fill very thin sections, it has a relatively high heat deflection temperature (approximately 315 degrees Centigrade), and it has a relatively high elongation-to-break ratio (approximately 2.2%). These characteristics allow the housing to be made in relatively small sizes with sufficient precision for the proper fit between the rotor and the housing, while also allowing the rotor to be inserted (as previously described) into the housing without fracturing the housing material. In addition, this material can withstand the thermal stresses of wave soldering (of the leads top a circuit board), which may subject the device to temperatures as high as about 260 degrees Centigrade.

The invention described above provides excellent sealing between the rotor and the housing without the use of an O-ring and its attendant disadvantages. It will be appreciated that, while a chevron-type seal is the preferred configuration for the rotor-to-housing seal, other configurations for the ridges 46 and grooves 54 that form this seal will be found to yield satisfactory results. Such variations and modifications of the present invention, and others that may suggest themselves to those skilled in the pertinent arts, should be considered within the spirit and scope of the invention, as defined in the claims which follow.

What is claimed is:

1. In a potentiometer, of the type having a substrate with a resistive element and a plurality of metallized conductive elements thereon, a rotor carrying conductive wiper means for electrically contacting the resistive element and at least one of the metallized conductive elements, and housing means containing the substrate and the rotor, a portion of the housing means forming a cavity that receives the rotor, the cavity having an interior wall surface that is engageable with a peripheral edge of the rotor, the improvement comprising:

sealing means, formed on the peripheral edge of the rotor and on the interior wall surface of the cavity, for creating a fluid-tight sealing engagement between the peripheral edge and the interior wall surface.

2. The potentiometer of claim 1, wherein the sealing means comprises means defining a chevron seal between the peripheral edge and the interior wall surface.

3. The potentiometer of claim 1, wherein the sealing means comprises:

an annular ridge on the peripheral edge of the rotor: and a complementary groove in the interior wall surface of the cavity;

the ridge and the groove having a fluid-tight interference fit therebetween that allows the rotation of the rotor within the cavity, and that also restrains the rotor from substantial axial movement with respect to the substrate.

4. The potentiometer of claim 2, wherein the means defining the chevron seal comprises:

an annular ridge on the peripheral edge of the rotor, the ridge having a substantially saw tooth configuration in axial cross-section, with a longer side and a shorter side of the saw tooth, the longer side being directed radially inwardly in the axial direction that is toward the substrate when the rotor is received in the cavity; and a complementary groove in the interior wall surface of the cavity;

the ridge and the groove having a fluid-tight interference fit therebetween that allows the rotation of the rotor within the cavity, and that restrains the rotor from substantial axial movement with respect to the substrate.

5. The potentiometer of claim 3, wherein the sealing means comprises at least two ridges and grooves.

6. The potentiometer of claim 4, wherein the sealing means comprises at least two ridges and grooves.

7. The potentiometer of claim 3, wherein the housing means is formed of a moldable thermoplastic, and wherein the rotor is formed of a metal.

8. The potentiometer of claim 7, wherein the thermoplastic is polyetheretherketone.

9. The potentiometer of claim 7, wherein the thermoplastic is polyketone.

10. The potentiometer of claim 4, wherein the housing means is formed of moldable thermoplastic, and wherein the rotor is formed of a metal.

11. The potentiometer of claim 10, wherein the thermoplastic is polyetheretherketone.

12. The potentiometer of claim 10, wherein the thermoplastic is polyketone.

13. An improved miniature single-turn potentiometer, of the type having a rotor mounted for rotation in a housing, the rotor having a peripheral edge engaging an interior wall surface of the housing, wherein the improvement comprises:

fluid-tight sealing means formed between the rotor and the housing solely by the engagement between the peripheral edge of the rotor and the interior wall surface of the housing.

14. The potentiometer of claim 13, wherein the engagement between the peripheral edge of the rotor and the interior wall surface of the housing restrains the rotor from substantial axial movement, while allowing the rotation of the rotor within the housing.

15. The potentiometer of claim 14, wherein the sealing means includes a chevron seal formed by the peripheral edge of the rotor and the interior wall surface of the housing.

16. The potentiometer of claim 15, wherein the chevron seal comprises:

an annular ridge on the peripheral edge of the rotor, the ridge having a substantially saw tooth configuration in axial cross-section; and a complementary groove in the interior wall surface of the housing;

whereby the groove receives the ridge with an interference fit.

17. The potentiometer of claim 16, wherein the rotor has a first surface directed toward the interior of the housing, and a second surface directed toward the exterior of the housing, and wherein the saw tooth configuration of the ridge has a long side and a short side, the long side being directed radially inwardly in the axial direction toward the first rotor surface.

18. The potentiometer of claim 16, wherein the chevron seal includes at least two ridges and complementary grooves.

19. The potentiometer of claim 13, wherein the thermoplastic is polyetheretherketone.

20. The potentiometer of claim 13, wherein the rotor is made of a metal.

21. The potentiometer of claim 13, wherein the thermoplastic is polyketone.

* * * * *

UNITED STATES PATENT AND TRADEMARK OFFICE

CERTIFICATE OF CORRECTION

PATENT NO. : 5,059,940

DATED : October 22, 1991

INVENTOR(S) : Ronald E. Thomas, Jr.

It is certified that error appears in the above-identified patent and that said Letters Patent is hereby corrected as shown below:

Column 3, Line 26: "lead 18" should read -- lead 28 --.

Column 4, Line 46: "top" should read -- to --.

Signed and Sealed this

Twenty-third Day of February, 1993

*Attest:*

STEPHEN G. KUNIN

*Attesting Officer*

*Acting Commissioner of Patents and Trademarks*